US005707788A

United States Patent [19]

Nishio

[11] Patent Number: 5,707,788

[45] Date of Patent: Jan. 13, 1998

[54] METHOD FOR PROCESSING SILVER HALIDE PHOTOGRAPHIC LIGHT-SENSITIVE MATERIAL

[75] Inventor: Shoji Nishio, Hino, Japan

[73] Assignee: Konica Corporation, Tokyo, Japan

[21] Appl. No.: 724,925

[22] Filed: Oct. 2, 1996

Related U.S. Application Data

[63] Continuation of Ser. No. 506,386, Jul. 24, 1995, abandoned.

[30] Foreign Application Priority Data

Aug. 11, 1994 [JP] Japan ..... 6-189454

[51] Int. Cl.[6] ..... G03C 5/31

[52] U.S. Cl. ..... 430/440; 430/264; 430/399; 430/446

[58] Field of Search ..... 430/398, 399, 430/440, 446, 480, 483, 264

[56] References Cited

U.S. PATENT DOCUMENTS

| | | | |
|---|---|---|---|
| 3,622,330 | 11/1971 | Valiaveedan | 430/268 |
| 4,025,344 | 5/1977 | Allen et al. | 430/399 |
| 4,046,571 | 9/1977 | Mertz | 430/399 |
| 4,228,234 | 10/1980 | Okutsu et al. | 430/399 |
| 4,245,034 | 1/1981 | Libicky et al. | 430/399 |
| 4,828,968 | 5/1989 | Okutsu | 430/398 |
| 5,196,298 | 3/1993 | Meens | 430/440 |
| 5,278,035 | 1/1994 | Knapp | 430/464 |
| 5,284,733 | 2/1994 | Kojima et al. | 430/264 |
| 5,382,507 | 1/1995 | Shimizu et al. | 430/399 |
| 5,457,009 | 10/1995 | Toyoda et al. | 430/399 |

FOREIGN PATENT DOCUMENTS

| | | |
|---|---|---|
| 0 569 068 A1 | 11/1993 | European Pat. Off. . |
| 0 573 700 A1 | 12/1993 | European Pat. Off. . |
| 0 585 792 A2 | 3/1994 | European Pat. Off. . |

*Primary Examiner*—Hoa Van Le

*Attorney, Agent, or Firm*—Frishauf, Holtz, Goodman, Langer & Chick, P.C.

[57] ABSTRACT

A method of processing a black and white silver halide photographic light sensitive material, using an automatic developing machine, the method comprising the steps of:

exposing the material; and developing the exposed material with developer, the developer being replenished with developer replenisher and the developer containing a dihydroxybenzene developing agent or a developing agent represented by Formula (A):

Formula (A)

wherein $R_5$ and $R_6$ independently represent an alkyl group, an amino group, an alkoxy group or an alkylthio group, or $R_5$ and $R_6$ combine with each other to form a ring; M represents a hydrogen atom or an alkali metal atom; k represents 0 or 1; and X represents —CO— or —CS—, wherein the method satisfies the following inequality:

$$1.1 \leqq D_R/D_S \leqq 2.5$$

in which $D_S$ represents the developing agent concentration of a fresh developer and $D_R$ represents the developing agent concentration of a running developer in stationary state.

11 Claims, No Drawings

METHOD FOR PROCESSING SILVER HALIDE PHOTOGRAPHIC LIGHT-SENSITIVE MATERIAL

This application is a Continuation of application Ser. No. 08/506,386, filed Jul. 24, 1995, now abandoned.

INDUSTRIAL FIELD OF THE INVENTION

The present invention relates to a method of processing a black and white silver halide photographic light sensitive material, and especially to a method of processing a black and white silver halide photographic light sensitive material in which developer waste is reduced and an image with stable photographic properties can be obtained.

BACKGROUND OF THE INVENTION

A black and white silver halide photographic light-sensitive material (hereinafter referred to also as a light sensitive material) is usually processed through the steps of exposing, developing, fixing, washing and drying. Recently, most light sensitive materials are processed using an automatic developing machine (hereinafter referred to also as an automatic processor), and a specific amount of a processing agent (developer etc.) is usually replenished in proportion to an area of light-sensitive materials processed. For example, it is usual in developer replenishment that the replenishing amount of developer replenisher is 250 ml or more, and especially 330 ml or more, per $m^2$ of a sheet-formed light sensitive material such as a light sensitive material for X-rays or graphic arts.

Since photographic waste has a high C.O.D. (chemical oxygen demand) or B.O.D. (biological oxygen demand), at present it is discarded after the waste is made harmless by chemical or biological treatments. These treatments result in increased cost, and there is a strong demand for reduction of the amount of developer waste.

On the other hand, when the developer replenisher amount is reduced, especially in a process of a light sensitive material containing a tetrazolium compound or a hydrazine derivative as a contrast increasing agent, there are problems such as deterioration of sensitivity, γ and maximum density. A solution of these problems is also strongly demanded.

SUMMARY OF THE INVENTION

The present invention has been made in view of the above. An object of the invention is to provide a method of developing a black and white silver halide photographic light-sensitive material using an automatic developing machine in which developer waste is reduced and an image with stable photographic properties can be obtained.

DETAILED DESCRIPTION OF THE INVENTION

The above-mentioned object of the present invention has been attained by the following methods;

(1) a method of processing a silver halide photographic light sensitive material with developer, using an automatic developing machine, the developer containing a dihydroxy benzene developing agent or a developing agent represented by Formula (A):

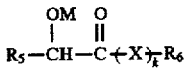

Formula (A)

wherein $R_5$ and $R_6$ independently represent an alkyl group, an amino group, an alkoxy group or an alkylthio group, or $R_5$ and $R_6$ combine with each other to form a ring; M represents a hydrogen atom or an alkali metal atom; k represents 0 or 1; and X represents —CO— or —CS—, wherein the method satisfies the following inequality:

$$1.1 \leqq D_R/D_S \leqq 2.5$$

in which $D_S$ represents the developing agent concentration of a developer starting solution (also referred to as a fresh developer) and $D_R$ represents the developing agent concentration of a running developer in stationary state;

(2) the method of (1) above, wherein the method satisfies the following:

$$1.2 \leqq D_R/D_S \leqq 2.5;$$

(3) the above method, wherein the developer is directly replenished with developer replenisher containing components different from those of the developer starting solution;

(4) the method of (3) above, wherein the developer replenisher is in the solid form;

(5) the method of (1), (2), (3) or (4) above, wherein the silver halide photographic light sensitive material contains a hydrazine compound represented by Formula (H):

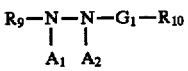

Formula (H)

wherein $R_9$ represents an aliphatic group or an aromatic group; $R_{10}$ represents a hydrogen atom, an alkyl group, an aryl group, an alkoxy group, an aryloxy group, an amino group, a hydrazino group, a carbamoyl group or an oxycarbonyl group; $G_1$ represents a carbonyl group, a sulfonyl group, a sulfoxy group,

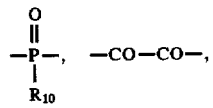

a thiocarbonyl group or an iminomethylene group; and $A_1$ and $A_2$ both are hydrogen atoms or when one of $A_1$ and $A_2$ represents a hydrogen atom, the other represents an alkylsulfonyl group, an arylsulfonyl group or an acyl group; or (6) the method of (1), (2), (3) or (4) above, wherein the silver halide photographic light sensitive material contains a tetrazolium compound represented by Formula (T):

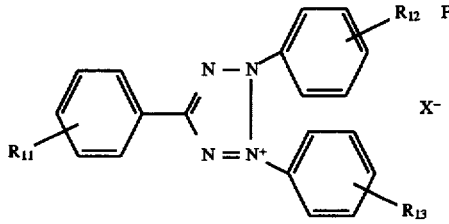

Formula (T)

wherein $R_{11}$, $R_{12}$, and $R_{13}$ independently represent a hydrogen atom or a substituent; and $X^-$ represents an anion.

The present inventors have evaluated replenishment maintaining development activity sufficient to obtain the stable photographic properties even in the case of reducing photographic waste with the parameter of a developing agent concentration in a running developer in stationary state, found a preferable replenishing method for realizing such a replenishment and arrived at the present invention.

The "running developer in stationary state" refers to a developer after developer replenisher (including replenishing water in the case of solid) is replenished in an amount of 1.5 times the developer tank volume of an automatic developing machine. After that, the developing agent concentration of the running developer arrives at a substantially constant value. In the invention the developer tank volume of the automatic developing machine of the invention is preferably 10 to 100 liter, and more preferably 10 to 50 liter.

The present invention is explained more in detail below.

The dihydroxy benzene developing agent in the invention is a compound represented by the following Formula (I), (II) or (III):

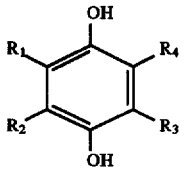

Formula (I)

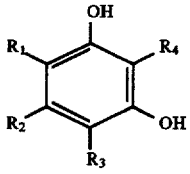

Formula (II)

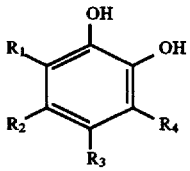

Formula (III)

wherein $R_1$, $R_2$, $R_3$ and $R_4$ independently represent a hydrogen atom, an alkyl group, an aryl group, a carboxy group, a halogen atom or a sulfo group.

The typical compound represented by Formula (I), (II) or (III), includes hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone or 2,5-dimethylhydroquinone. The most generally used compound is hydroquinone.

In order to obtain the desired sensitivity or the maximum density, the amount used of the dihydroxybenzene developing agent is not less than 0.075 mol per liter of developer, and preferably, 0.1 to 1 mol per liter of developer.

In Formula (A), Formula (A) can be an isomer represented by the following Formula (A') (so-called tautomerizm):

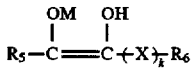

Formula (A')

The compound represented by the following Formula (A-a) in which $R_5$ and $R_6$ in the above mentioned Formula (A) combine with each other to form a ring is preferable.

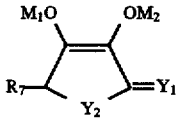

Formula (A-a)

wherein $R_7$ represents a hydrogen atom, an alkyl group, an aryl group, an amino group, an alkoxy group, a sulfo group, a carboxy group, an amido group or a sulfonamido group; $M_1$ and $M_2$ independently represent a hydrogen atom or an alkali metal atom; $Y_1$ represents O or S; and $Y_2$ represents O, S or $NR_8$ in which $R_8$ represents a hydrogen atom, an alkyl group or an aryl group.

In the above Formulas (A) and (A-a), the alkyl group in the above Formulas (A) and (A-a) represents preferably a lower alkyl group, for example, an alkyl group having 1 to 5 carbon atoms, the amino group represents preferably an unsubstituted amino group or an amino group having a lower alkyl group having 1 to 5 carbon atoms, the alkoxy group represents preferably a lower alkoxy group having 1 to 5 carbon atoms, the aryl group represents preferably a phenyl or naphthyl group, lower alkoxy group which may have a substituent preferably including a hydroxy group, a halogen atom, an alkoxy group, a sulfo group, a carboxyl group, an amido group or a sulfonamido group.

The content of the compound by Formula (A) or (A-a) is 0.02 to 1.5 mol/liter, preferably 0.05 to 0.5 mol/liter, and more preferably 0.15 to 0.3 mol/liter of developer.

The typical example of a developing agent in the invention represented by the above Formula (A) or (A-a) will be shown below, but the invention is not limited thereto.

Formula (A)

| Compound No. | X | $R_5$ | $R_6$ | M |
|---|---|---|---|---|
| A-1 | — (k = 0) | $HOCH_2CH(OH)—CH(OH)—$ | —OH | H |
| A-2 | — (k = 0) | $CH_3CH(OH)—CH(OH)—$ | —OH | H |
| A-3 | — (k = 0) | $HOCH_2CH(OH)—CH(OH)—$ | $—CH_3$ | H |
| A-4 | — (k = 0) | $CH_3CH(OH)—CH(OH)—$ | $—CH_3$ | H |
| A-5 | —C(=O)— (k = 1) | $HOCH_2CH(OH)—CH(OH)—$ | —OH | H |

-continued

Formula (A)

| Compound No. | X | $R_5$ | $R_6$ | M |
|---|---|---|---|---|
| A-6 | O ‖ —C— (k = 1) | $CH_3CH(OH)-CH(OH)-$ | —OH | H |
| A-7 | S ‖ —C— (k = 1) | $HOCH_2CH(OH)-CH(OH)-$ | —OH | H |
| A-8 | S ‖ —C— (k = 1) | $CH_3CH(OH)-CH(OH)-$ | —OH | H |
| A-9 | O ‖ —C— (k = 1) | $HO-CH_2-$ | —OH | H |
| A-10 | O ‖ —C— (k = 1) | $HO-CH_2-$ | $-CH_2$ | H |
| A-11 | O ‖ —C— (k = 1) | $HO-CH_2-$ | $-C_2H_5$ | H |
| A-12 | O ‖ —C— (k = 1) | $HO-CH_2-$ | $-C_2H_4OH$ | H |
| A-3' | — (k = 0) | $HOCH_2CH(OH)-CH(OH)-$ | $-CH_3$ | Na |
| A-4' | — (k = 0) | $CH_3CH(OH)-CH(OH)-$ | $-CH_3$ | Na |
| A-5' | O ‖ —C— (k = 1) | $HOCH_2CH(OH)-CH(OH)-$ | —OH | Na |
| A-6' | O ‖ —C— (k = 1) | $CH_3CH(OH)-CH(OH)-$ | —OH | Na |
| A-7' | S ‖ —C— (k = 1) | $HOCH_2CH(OH)-CH(OH)-$ | —OH | Na |

Formula (A-a)

| Compound No. | $Y_1$ | $Y_2$ | $R_7$ | $M_1$ | $M_2$ |
|---|---|---|---|---|---|
| A-13 | O | O | H | H | H |
| A-14 | O | O | $CH_3$ | H | H |
| A-15 | O | O | $CH_2$ \| OH | H | H |
| A-16 | O | O | $CH_3CH(OH)-$ | H | H |
| A-17 | O | O | $HOCH_2CH(OH)-$ | H | H |
| A-18 | O | O | $ClCH_2CH(OH)-$ | H | H |
| A-19 | O | O | $HOOCCH_2CH(OH)-$ | H | H |

-continued

Formula (A-a)

| Compound No. | $Y_1$ | $Y_2$ | $R_7$ | $M_1$ | $M_2$ |
|---|---|---|---|---|---|
| A-20 | S | O | H | H | H |
| A-21 | S | O | $CH_3CH(OH)-$ | H | H |
| A-22 | S | O | $HOCH_2CH(OH)-$ | H | H |
| A-23 | O | $NCH_3$ | H | H | H |
| A-24 | O | NH | $HOCH_2CH(OH)-$ | H | H |
| A-25 | O | S | H | H | H |
| A-26 | O | S | $HOCH_2CH(OH)-$ | H | H |
| A-27 | O | S | $CH_3CH(OH)-$ | H | H |
| A-28 | S | S | H | H | H |
| A-29 | S | S | $HOCH_2CH(OH)-$ | H | H |
| A-30 | S | S | H | H | H |
| A-31 | O | O | $HOCH_2CH(OH)-$ | Na | H |
| A-17' | O | O | $HOCH_2CH(OH)-$ | Na | H |
| A-19' | O | O | $HOOCCH_2CH(OH)-$ | Na | H |
| A-23' | O | $NCH_3$ | H | Na | H |
| A-26' | O | S | $HOCH_2CH(OH)-$ | Na | H |

These compounds are representatively ascorbic acid or erythorbic acid or derivatives thereof. They are available on the market and can be easily synthesized according to the well known synthesis method.

The auxiliary developing agent in the invention showing superadditivity together with the developing agent represented by Formula (A) includes 3-pyrazolidone derivatives or p-aminophenol derivatives. These compounds are well known for auxiliary developing agents. Typical compounds of the auxiliary developing agents will be shown below, but the invention is not limited thereto.

1-phenyl-3-pyrazolidone
1-phenyl-4,4'-dimethyl-3-pyrazolidone
1-phenyl-4-methyl-4-hydroxymethyl-3-pyrazolidone
1-phenyl-5-methyl-3-pyrazolidone
1-p-aminophenyl-4,4'-dimethyl-3-pyrazolidone
1-p-tolyl-4,4'-dimethyl-3-pyrazolidone
1-p-tolyl-4-methyl-4-hydroxymethyl-3-pyrazolidone
N-methyl-p-aminophenol
N-(β-hydroxyethyl)-p-aminophenol N-(4-hydroxyphenyl)glycine 2-methyl-p-aminophenol p-benzyl-p-aminophenol The content of these compounds is usually 0.1 to 15 g/liter of developer, and preferably 0.5 to 5 g/liter of developer. When these compounds are used in combination with a developing agent represented by Formula (A), the content thereof is preferably 1 to 4.0 g/liter of developer.

In the invention the more stable photographic properties of an image formed on a light-sensitive material processed can be obtained using a developer which contains a compound represented by the following Formula (Y-1), (Y-2) or (Y-3).

Formula (Y-1)

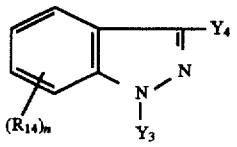

Formula (Y-2)

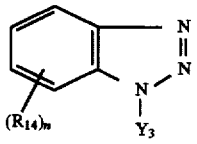

Formula (Y-3)

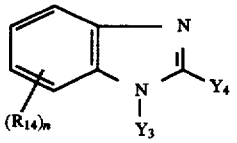

wherein $Y_3$ represents a hydrogen atom, an alkali metal atom or a mercapto group; $R_{14}$ and $Y_4$ independently represent a hydrogen atom, a halogen atom, a nitro group, an amino group, a cyano group, a hydroxy group, a mercapto group, a sulfo group, a substituted or unsubstituted alkyl group, a substituted or unsubstituted alkenyl group, a substituted or unsubstituted alkinyl group, a substituted or unsubstituted alkoxyl group, a hydroxycarbonyl group, an alkylcarbonyl group or an alkoxylcarbonyl group; and n represents an integer of 1 to 4.

Typical compounds represented by Formula (Y-1) will be shown below, but the invention is not limited thereto.

Y-1-1 5-nitroindazole

Y-1-2 6-nitroindazole

Y-1-3 5-sulfoindazole

Y-1-4 5-cyanoindazole

Y-1-5 6-cyanoindazole

Y-1-6 5-mercaptoindazole

Typical compounds represented by Formula (Y-2) will be shown below, but the invention is not limited thereto.

Y-2-1 benzotriazole

Y-2-2 5-methylbenzotriazole

Y-2-3 5-chlorobenzotriazole

Y-2-4 5-nitrobenzotriazole

Y-2-5 5-ethylbenzotriazole

Y-2-6 5-carboxybenzotriazole

Y-2-7 5-hydroxybenzotriazole

Y-2-8 5-aminobenzotriazole

Y-2-9 5-sulfobenzotriazole

Y-2-10 5-cyanobenzotriazole

Y-2-11 5-methoxybenzotriazole

Y-2-12 5-ethoxylbenzotriazole

Y-2-13 5-mercaptobenzotriazole

Typical compounds represented by Formula (Y-3) will be shown below, but the invention is not limited thereto.

Y-3-1 benzimidazole

Y-3-2 5-sulfobenzimidazole

Y-3-3 5-methoxybenzimidazole

Y-3-4 5-chlorobenzimidazole

Y-3-5 5-nitrobenzimidazole

Y-3-6 2-mercapto-5-sulfobenzimidazole

These compounds are well known in the art for antifoggants, and can be easily obtained according to the conventional method and some of these compounds are marketed as a chemical reagent.

The content in a developer of a compound represented by Formula (Y-1), (Y-2) or (Y-3) is preferably 0.001 to 2 g per liter.

As a sulfite which may be contained in the developer in the invention, sodium sulfite, potassium sulfite, lithium sulfite, ammonium sulfite, sodium bisulfite, sodium metabisulfite and a formaldehyde-sodium bisulfite adduct are cited. the sulfite content of the developer is preferably 0.30 to 2.5 mol/liter, and more preferably 0.40 to 1.2 mol/liter.

The developer in the invention may contain amino compounds described in Japanese Patent O.P.I. Publication Nos. 56-106244/1985 and 61-267759/1986 and Japanese Patent O.P.I. Publication No. 2-208652/1991 in order to promote development.

The pH of the developer replenisher in the invention is preferably 9.5 to 12.3, and water soluble inorganic alkali metal salts such as sodium hydroxide and sodium carbonate can be used for adjusting a pH value.

Besides these agents the developer may contain pH buffering agents such as boric acid, borates, sodium triphosphates, potassium triphosphates and compounds described in Japanese Patent O.P.I. Publication No. 60-93433/1985, development inhibitors such as potassium bromide and potassium iodide, organic acids such as dimethylformamide, methylcellosolve, hexylene glycol, ethanol and methanol, antifoggants and black spot preventing agents such as indazoles (5-nitroindazole) and benzotriazole (5-methylbenzotriazole), toning agents, surfactants, water softening agents or hardeners.

The developer preferably contains a chelating agent which forms a chelating compound with a ferric ion ($Fe^{3+}$) having a chelating stability constant of 8 or more, in view of stabilization of the developer. The chelating stability constant referred to herein is well known in L. G. Sillen & A. E. Martell, "Stability Constants of Metal Complexes", The Chemical Society, London (1964) and S. Chaberek & A. E. Martell, "Organic Sequestering Agents", Willey (1959).

The chelating agent includes an organic carbonic acid chelating agent, an organic phosphoric acid chelating agent, an inorganic phosphoric acid chelating agent, and a polyhydroxy compound. For example, ethylenediamine diorthohydroxyphenyl acetic acid, diaminopropanetetraacetic acid, nitrilotriacetic acid, hydroxyethylethylenediamine triacetic acid, dihydroxyethylglycine, ethylenediaminediacetic acid, ethylenediamine-2-propionic acid imino diacetic acid, diethylenetriamine pentaacetic acid, hydroxyethyliminodiacetic acid, 1,3-diaminopropanol tetraacetic acid, transcyclohexanediaminetetraacetic acid, ethylenediaminetetraacetic acid, triethylenetetraminehexaacetic acid, glycoletherdiaminetetraacetic acid, ethylenediaminetetrakismethylenephosphonic acid, diethylenetriaminepentamethylenephosphonic acid, nitrilotrimethylenephosphonic acid, 1-hydroxyethylidene-1, 1-diphosphonic acid, 1,1-diphosphonoethane-2-carboxylic acid, 2-phosphonobutane-1,2,4-tricarboxylic acid, 1-hydroxy-1-phosphonopropane-1,2,3-tricarboxylic acid, catechol-3,5-disulfonic acid, sodium pyrophosphate, sodium tetrapolyphosphate and sodium hexametaphosphate.

The chelating agent preferably includes diethylenetriamine pentaacetic acid, triethylenetetraminehexaacetic acid, 1,3-diaminopropanol tetraacetic acid, glycoletherdiaminetetraacetic acid, hydroxyethylethylenediamine triacetic acid, 2-phosphonobutane-1,2,4-tricarboxylic acid, 1,1-diphosphonoethane-2-carboxylic acid, nitrilotrimethylenephosphonic acid, ethylenediaminetetraphosphonic acid, diethylenetriaminepentaphosphonic acid, 1-hydroxypropylidene-1,1-phosphonic acid and 1-hydroxyethylidene-1,1-phosphonic acid.

The chelating agent content of developer is 0.01 to 50 g/liter, and preferably 0.05 to 20 g/liter.

The pH of developer is 9.5 to 11.8, and especially preferable, 9.7 to 10.8.

The hardeners which may be used in developer includes glutaraldehyde, α-methylglutaraldehyde, β-methylglutaraldehyde, maleic dialdehyde, succinic dialdehyde, methoxysuccinic dialdehyde, methylsuccinic dialdehyde, α-methoxy-β-ethoxyglutaraldehyde, α-n-butoxyglutaraldehyde, α,α-dimethoxysuccinic dialdehyde, β-isopropylsuccinic dialdehyde, α,α-diethylsuccinic dialdehyde and butylmaleic dialdehyde.

Besides the above compounds, the developer may contain additives described on pages 226–229 of L. F. A. Maison, "Photographic Processing Chemistry", Focal Press (1966), or in U.S. Pat. Nos. 2,193,015 and 2,592,364 and Japanese Patent O.P.I. Publication No. 48-64933/1973.

The process of the invention using an automatic developing machine comprises the steps of exposing, developing, fixing, washing or stabilizing and drying in that order. The automatic developing machine may be of any type such as roller transporting type or belt transporting type, but is preferably of the roller transporting type. Automatic developing machines having a small opening to the tanks allow less air oxidation or less vaporization, and enables stable processing under any circumstance and further enables reduced replenishment.

The fixer in the fixing step is an aqueous solution of pH 3.8 or more (preferably 4.2 to 5.5) containing a thiosulfate (preferably ammonium thiosulfate) as a fixing agent in an amount of usually 0.1 to 3 mol/liter.

The fixer may contain a water soluble aluminium salt as a hardener (aluminium chloride, aluminium sulfate, potash alum etc.), tartaric acid, citric acid, gluconic acid, a preservative (a sulfite, bisulfite etc.), a pH buffering agent (acetic acid, boric acid etc.), a pH adjusting agent (surfuric acid etc.), a chelating agent capable of softening hard water and compounds described in Japanese Patent O.P.I. Publication No. 62-78551/1987.

As a method of reducing the replenishing amount of water, a counter-current washing with multiple stages is known. In this water-saving processing, washing water or stabilizer is preferably subjected to anti-fungal treatments.

Means for anti-fungal treatments include an ultra-violet radiation method described in Japanese Patent O.P.I. Publication No. 60-263939/1985, a method using a magnetic field described in Japanese Patent O.P.I. Publication No. 60-263940/1985, a method for making pure water using an ion-exchange resin described in Japanese Patent O.P.I. Publication No. 61-131632/1986 and a method using fungicide described in Japanese Patent O.P.I. Publication No. 62-115154/1987.

When a light sensitive material is washed with a small amount of water, a squeezing roller washing tank described in Japanese Patent O.P.I. Publication No. 63-18350/1988 or a washing step described in Japanese Patent O.P.I. Publication No. 63-143548/1988 is preferably provided.

The washing water or stabilizer is replenished with water, which is subjected to anti-fungal treatments, in proportion to the area of the processed material and the replenishment produces overflow. A part or all of the overflow produced in the washing or stabilizing step can be added to thein proportion to the area of the processed material processing solution having fixing ability, which is used in a pre-step of the washing or stabilizing step, as described in Japanese Patent O.P.I. Publication No. 60-235133/1985.

In the invention, developer or fixer may be optionally replenished with water. It is effective especially when a solid processing agent is used.

In the invention, developing time is preferably 5 seconds to 3 minutes (more preferably 8 seconds to 2 minutes), developing temperature is preferably 18°–50° C. (more preferably 20°–40° C.), fixing temperature and fixing time are preferably 18°–50° C. and 5 seconds to 3 minutes (more preferably 20°–40° C. and 6 seconds to 2 minutes), respectively, and washing temperature and time are preferably 0°–50° C. and 6 seconds to 3 minutes (more preferably 15°–40° C. and 6 seconds to 2 minutes), respectively. Herein, "developing time" refers to the time taken from entry of the leading edge of a film in the developing tank solution of an automatic developing machine to its entry in the next fixer tank solution; "fixing time" refers to the time taken from entry of the edge in the fixer tank solution to its entry in the next washing tank solution (or stabilizing solution); "washing time" refers to the time while the film was immersed in a washing tank solution; and "drying time" refers to time while the film was passing a drying zone supplied with a hot air of 35°–100° C., and more preferably, 40°–80° C., with which the automatic processor is usually equipped.

According to the invention, the developed, fixed and washed (stabilized) silver halide photographic light-sensitive material is dried after passing between squeezing rollers to squeeze a washing water. Drying is carried out at 40°–100° C. for usually 5 seconds to 3 minutes (preferably at 40°–80° C. for 5 seconds to 3 minutes).

When in the invention a light sensitive material is subjected to rapid processing such as Dry to Dry processing of 100 seconds or less, the following means are preferably carried out. A rubber roller as described in Japanese Patent O.P.I. Publication No. 63-151943/1988 is provided at an outlet of a developing tank to prevent development unevenness often produced in the rapid processing, a developer injecting rate for stirring the developer is not less than 10 m/minute as described in Japanese Patent O.P.I. Publication No. 63-151944/1988, and more vigorous stirring of developer is carried out while processing than while non-processing as described in Japanese Patent O.P.I. Publication No. 63-264758/1988. The roller of a fixing tank is preferably a counter roller, because with such, the fixing rate can be increased, the number of rollers can be reduced, and the fixing tank can be more compact.

The present invention is characterized in that the relationship between concentration $D_S$ of a dihydroxy benzene developing agent or an ascorbic acid developing agent represented by Formula (A) in a fresh developer and concentration $D_R$ of the running developer in stationary state satisfies the following inequality:

$$1.1 \leqq D_R/D_S \leqq 2.5$$

Concretely, this relation can be assured by a composition of developer replenisher and a replenishing method of developer replenisher.

The composition of developer replenisher in the invention may be the same as or different from that of developer employed at the beginning of development (a developer starting solution), however, it is preferable that the developer replenisher contains components, which are dissolved out of developed light sensitive material and accumulated, in a lower concentration than those of the starting developer solution and components, which are carried by the light sensitive material being processed and reduced, in a higher concentration than those of the starting developer solution. For example, the accumulated components include a halogen ion, and the reduced components include the above described development inhibitors represented by Formulas (Y-1) through (Y-3) or compounds having a mercapto group.

The developer replenisher may be in the form of a concentrated solution of the starting solution or in the form of a solid, but the solid replenisher is preferable in view of stabilizing its concentration in a running developer in stationary state.

The solid processing agent is preferably powder or granules which are granulation-molded, and more preferably the granules.

The granulating method includes compression granulation, extrusion granulation, stirring granulation and fluidized-layer granulation. The granule form may be granules of a small size, tablets of a relatively large size or lump in the form of bricks, preferably granules or tablets, and more preferably spherical granules having a diameter of 0.1 to 3 mm. The surface of the granules may be coated with a water soluble polymer to prevent oxidation or blocking (a secondary aggregation of granules). A binder may be optionally used in granulation.

Water or a granulation auxiliary agent generally used is preferably used as a binder. The binder is a water soluble, alkaline solution soluble or acid solution soluble polymer, and includes gelatin, pectin, polyacrylic acid, polyacrylic acid salt, polyvinyl alcohol, polyvinyl pyrrolidone, copolyvinyl pyrrolidone-vinyl acetate, polyethylene oxide, sodium carboxymethyl cellulose, hydroxypropyl cellulose, methyl cellulose, ethyl cellulose, alginic acid salt, gum arabic, tragacanth gum, carrageenin, copolymethylvinylethermaleic anhydride, polyoxyethylenealkylether such as polyoxyethyleneethylether or polyoxyethylenestearylether, polyoxyethylenealkylphenylether such as polyoxyethyleneoctylphenylether or polyoxyethylenenonylphenylether, or one or more kinds selected from the water soluble compounds described in Japanese Patent O.P.I. Publication No. 4-85535/1992.

The amount of the binder is not more than 20 weight % based on the granules. When the amount exceeds 20 weight %, granules is in the form of paste, the granules adheres to a vessel for granules and adhered granules must be washed away with water, resulting in difficulty of handling and no advantage of granulation.

The solid processing agent in the invention may be dissolved in water for replenishment, or directly dissolved in developer in an automatic developing machine. The replenishment is carried out in proportion to an area of a light sensitive material processed, and especially to a developable area of a light sensitive material.

The hydrazine compound contained in the light sensitive material to be developed in the invention is a compound represented by Formula (H).

The typical compounds represented by the above Formula (H) will be shown below.

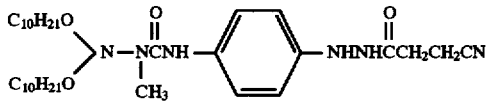

H-1

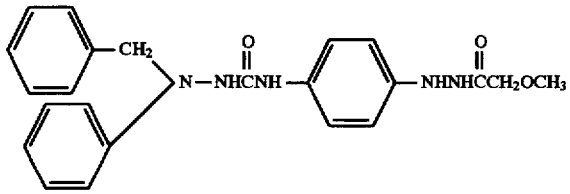

H-2

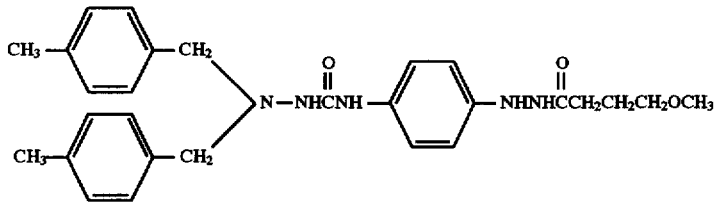

H-3

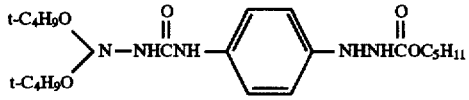

H-4

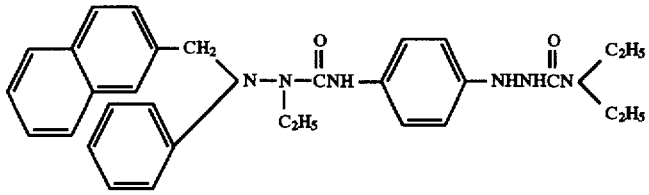

H-5

-continued
H-6
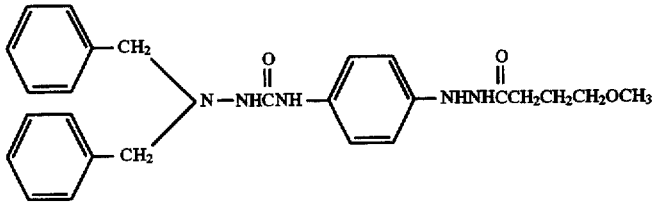
H-7
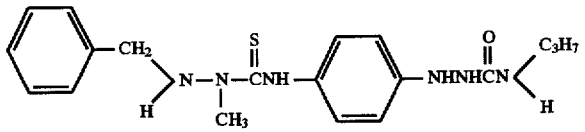
H-8
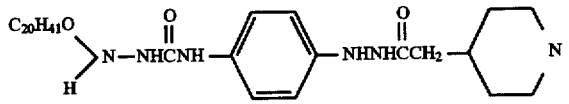
H-9
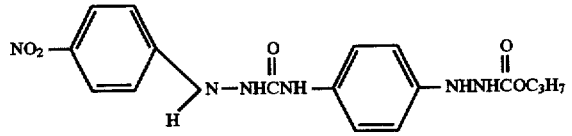
H-10
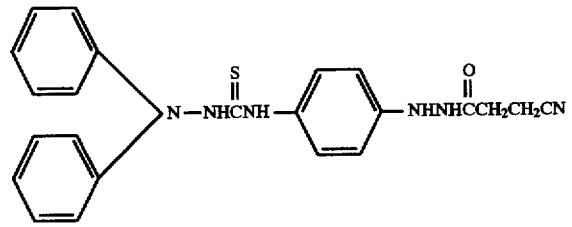
H-11
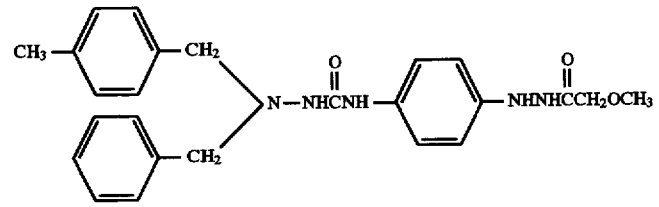
H-12
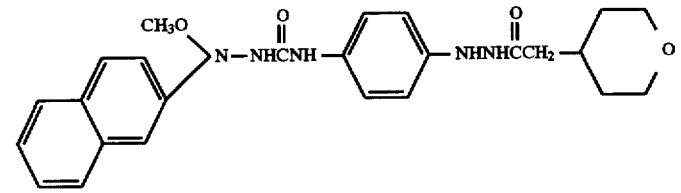
H-13
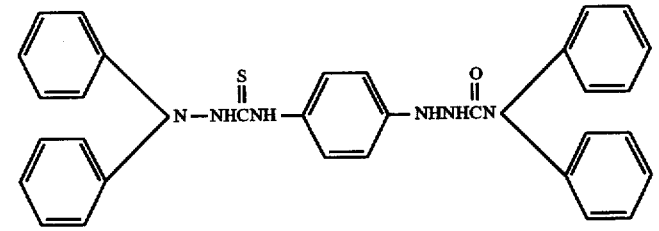
H-14
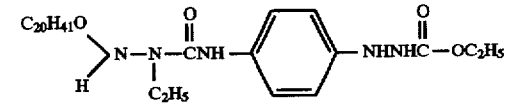

-continued
H-15
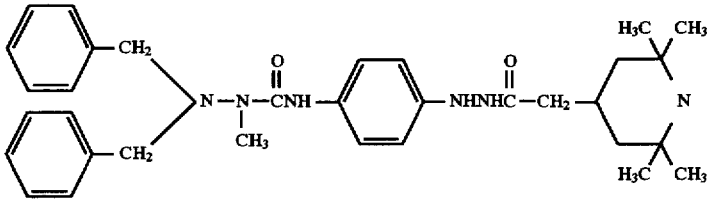
H-16
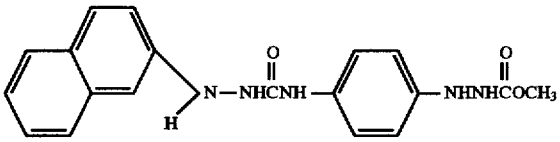
H-17
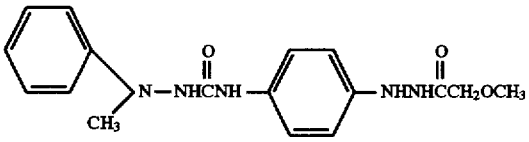
H-18
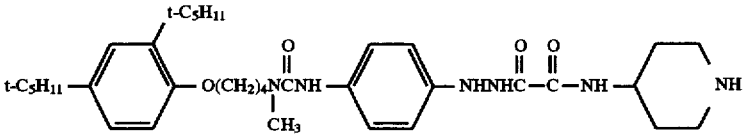
H-19
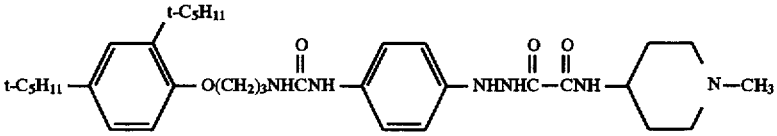
H-20
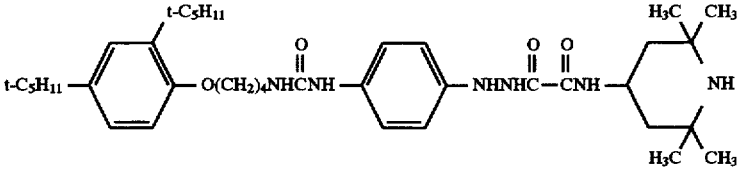
H-21
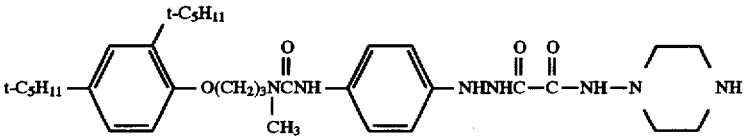
H-22
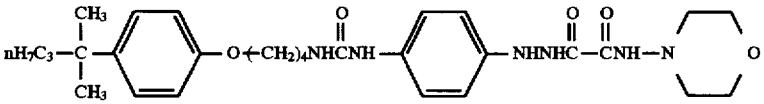
H-23
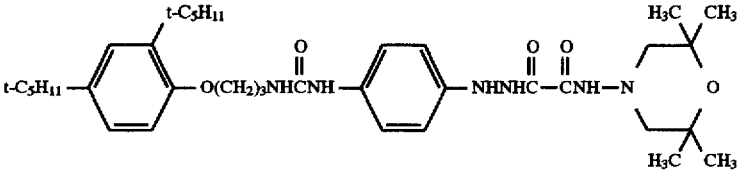
H-24
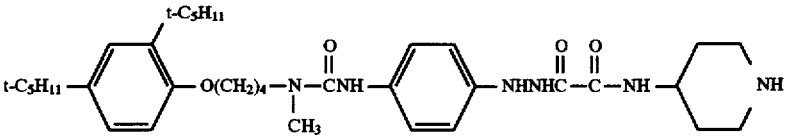

-continued
H-25
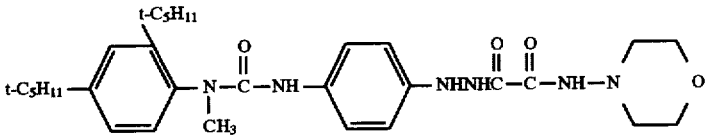
H-26
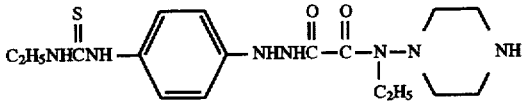
H-27
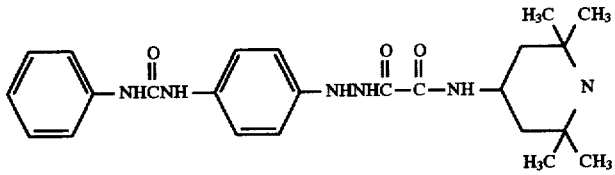
H-28
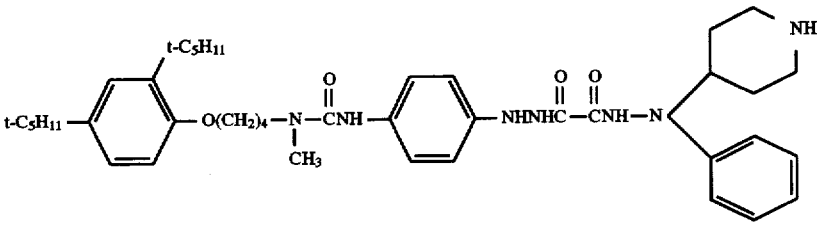
H-29
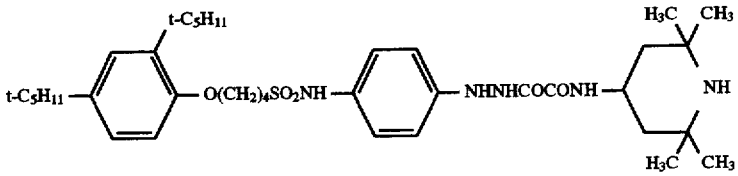
H-30
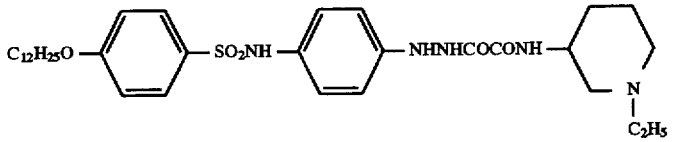
H-31
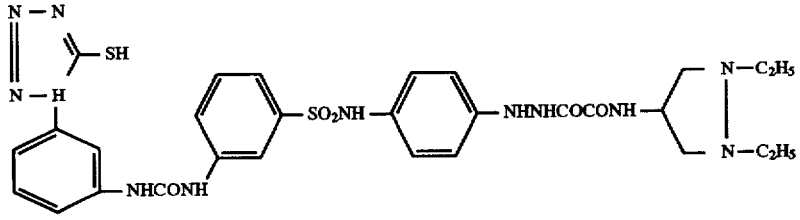
H-32
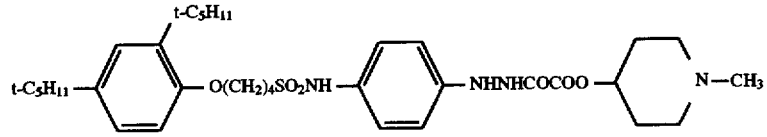
H-33
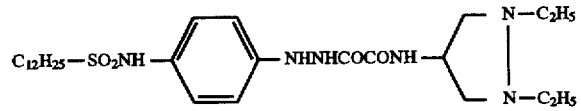
H-34
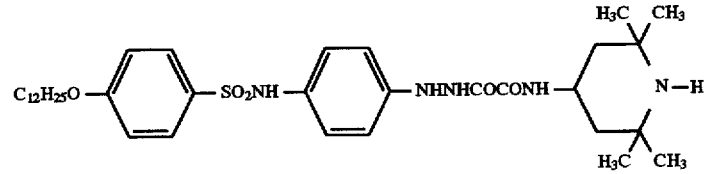

-continued

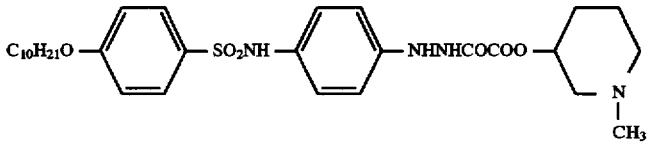

H-35

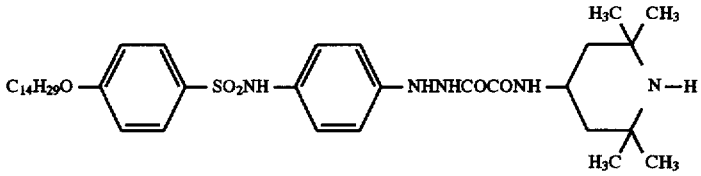

H-36

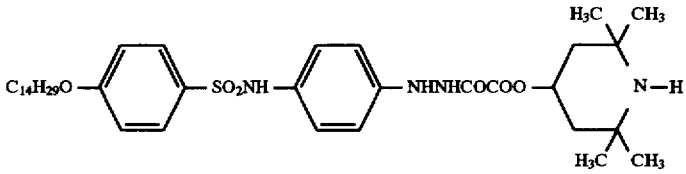

H-37

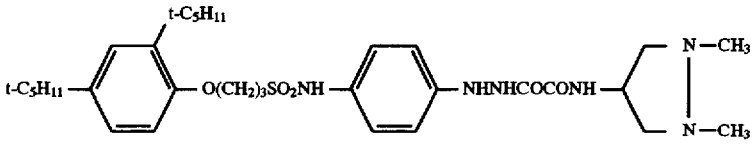

H-38

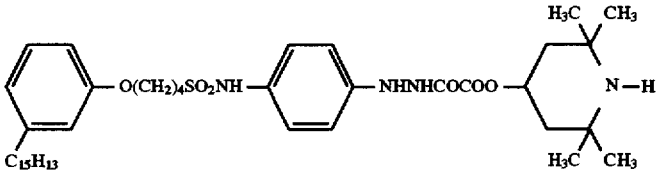

H-39

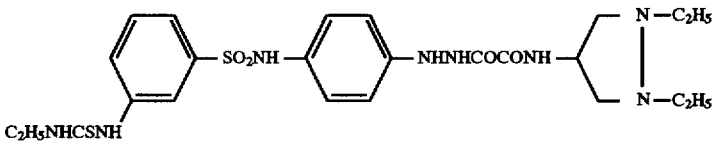

H-40

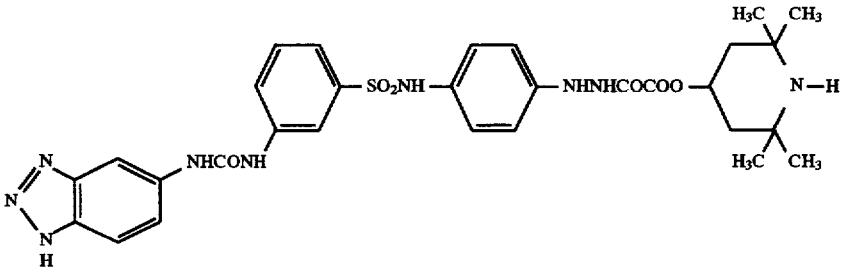

H-41

When a hydrazine represented by the following Formula is used,

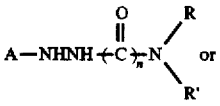

A—NHNH—CO—CO—O—R", wherein A represents an aryl group or a heterocyclic group containing at least one of a sulfur atom and an oxygen atom; n represents an integer of 1 or 2; R and R' independently represent a hydrogen atom, an alkyl group (for example, methyl, ethyl, methoxyethyl, cyanoethyl, hydroxyethyl, benzyl or trifluoroethyl), an alkenyl group (for example, allyl, butenyl, pentenyl or pentadienyl), an alkinyl group (for example, propagyl, butinyl or pentinyl), an aryl group (for example, phenyl, naphthyl, cyanophenyl or methoxyphenyl), a heterocyclic group (for example, pyridinyl, thienyl, furyl, tetrahydrofuryl or sulfolyl), a hydroxy group, an alkoxy group (for example, methoxy, ethoxy, benzyloxy or cyanomethoxy), an alkenyloxy group (for example, allyloxy or butenyloxy), an alkinyloxy group (for example, propagyloxy or butinyloxy), an aryloxy group (for example, phenoxy or naphthyloxy) or a heterocyclicoxy group (for example, pyridyloxy or pyrimidyloxy) provided that, when n is 1, R and R' may combine with each other to form a ring (for example, piperidine, piperazine or morphorine) and when n is 2, one of R and R' represents an alkenyl group, an alkinyl group, a saturated heterocyclic group, a hydroxy group, an alkoxy group, an alkenyloxy group, an alkinyloxy group, an aryloxy group or a heterocyclicoxy group; and R" represents an alkinyl group or a saturated heterocyclic group, it is preferable that a silver halide emulsion layer and/or a non-light-sensitive layer on a support of the emulsion side contains at least one nucleation accelerating compound described on page 18, upper right column, line 2 through page 37, upper left column, line 21 of Japanese Patent O.P.I. Publication No. 4-114145/1992.

The content of the nucleation accelerating compound is $5\times10^{-7}$ to $5\times10^{-1}$ mol per mole of Ag, and preferably $5\times10^{-6}$ to $5\times10^{-2}$ mol per mole of Ag.

The typical nucleation accelerating compounds will be shown below.

N-1

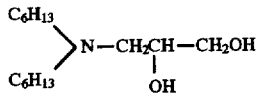

N-2

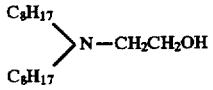

N-3

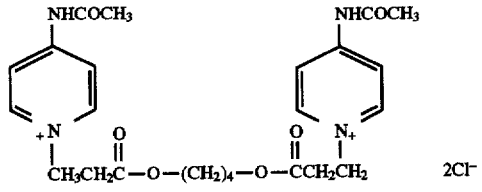

N-4

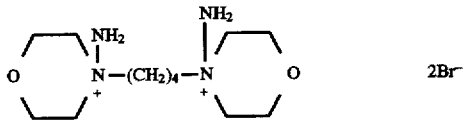

N-5

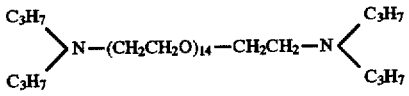

N-6

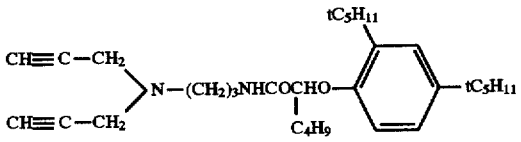

N-7

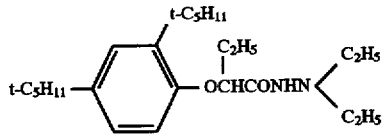

N-8

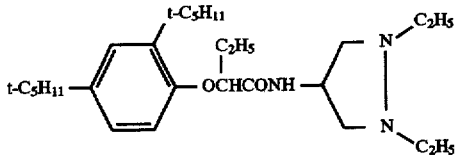

N-9

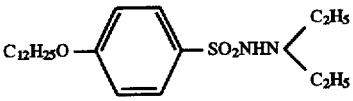

-continued

N-10

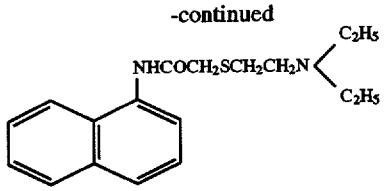

Besides the above compounds, the typical compounds include compounds (I-1) through (I-26) described on pages 69 through 72, compounds (II-1) through (II-29) described on pages 73 through 78, compounds (III-1) through (III-25) described on pages 80 through 83, compounds (IV-1) through (IV-41) described on pages 84 through 90, compounds (V-1-1) through (V-1-27) described on pages 92 through 96, compounds (V-II-1) through (V-II-30) described on pages 98 through 103, compounds (V-III-1) through (V-III-35) described on pages 105 through 111, compounds (IV-I-1) through (IV-I-44) described on pages 113 through 121, compounds (VI-II-1) through (VI-II-68) described on pages 123 through 135, and compounds (VI-III-1) through (VI-III-35) described on pages 137 through 143, of Japanese Patent O.P.I. Publication Nos. 4-114145/1992, except for the above exemplified compounds.

Besides the above compounds, the typical compounds include compounds (1) through compounds (61) and compounds (65) through compounds (75) disclosed on pages 542 (4) through 546 (8) of Japanese Patent O.P.I. Publication Ns. 2-841/1990.

The hydrazine compounds represented by Formula (H) can be synthesized by a method disclosed on pages 546 (8) through 550 (12) of Japanese Patent O.P.I. Publication Ns. 2-841/1990.

The hydrazine compounds are contained in a silver halide emulsion layer and/or its adjacent layers of a photographic light sensitive material. The content of the compounds is preferably $1\times10^{-6}$ to $1\times10^{-1}$ mol/mol of silver, and more preferably $1\times10^{-5}$ to $1\times10^{-2}$ mol/mol of silver.

The tetrazolium compound in the invention is contained in a silver halide emulsion layer or its adjacent layers of the light sensitive material, and the content of the tetrazolium compound is $5\times10^{-7}$ to $5\times10^{-1}$ mol per mole of Ag, and preferably $5\times10^{-6}$ to $5\times10^{-2}$ mol per mole of Ag.

The tetrazolium compound contained in the light sensitive material to be processed in the invention is represented by Formula (T).

In Formula (T), the preferable examples of the substituents represented by $R_{11}$ through $R_{13}$ include an alkyl group (such as methyl, ethyl, cyclopropyl, propyl, isopropyl, cyclobutyl, butyl, isobutyl, pentyl or cyclohexyl), an amino group, an acylamino group (such as acetylamino), a hydroxyl group, an alkoxy group (such as methoxy, ethoxy, propoxy, butoxy or pentoxy), an acyloxy group (such as acetyloxy), a halogen atom (such as fluorine, chlorine or bromine), a carbamoyl group, an acylthio group (such as acetylthio), an alkoxycarbonyl group (such as ethoxycarbonyl), a carboxyl group, an acyl group (such as acetyl), a cyano group, a nitro group, a mercapto group, a sulfoxy group and an aminosulfoxy group.

The anion represented by the above-denoted $X^-$ includes, for example, a halogen ion such as a chloride ion, a bromide ion or an iodide ion, an inorganic acid residue such as nitric acid, sulfuric acid or perchloric acid, an organic acid residue such as sulfonic acid or carboxylic acid, an anionic surface active agent typically including a lower alkyl benzene sulfonic acid anion such as a p-toluene sulfonic acid anion, a higher alkyl benzene sulfonic acid anion such as a p-dodecyl benzene sulfonic acid anion, a higher alkyl sulfate anion such as a lauryl sulfate anion, a borate anion such as a tetraphenyl borate, a dialkyl sulfosuccinate anion such as a di-2-ethylhexyl succinate anion, a polyether alcohol sulfate anion such as acetyl polyetheroxy sulfate anion, a higher aliphatic anion such as a stearic acid anion, and a polymer with an acid residue such as a polyacrylic acid anion.

The concrete examples of the compounds represented by Formula (T) will be given below, but the compounds of the invention shall not be limited thereto.

| Compound No. | $R_{11}$ | $R_{12}$ | $R_{13}$ | $X^-$ |
|---|---|---|---|---|
| T-1 | H | H | H | $Cl^-$ |
| T-2 | H | p-$CH_3$ | p-$CH_3$ | $Cl^-$ |
| T-3 | H | m-$CH_3$ | m-$CH_3$ | $Cl^-$ |
| T-4 | H | o-$CH_3$ | o-$CH_3$ | $Cl^-$ |
| T-5 | p-$CH_3$ | p-$CH_3$ | p-$CH_3$ | $Cl^-$ |
| T-6 | H | p-$OCH_3$ | p-$OCH_3$ | $Cl^-$ |
| T-7 | H | m-$OCH_3$ | m-$OCH_3$ | $Cl^-$ |
| T-8 | H | o-$OCH_3$ | o-$OCH_3$ | $Cl^-$ |
| T-9 | p-$OCH_3$ | p-$OCH_3$ | p-$OCH_3$ | $Cl^-$ |
| T-10 | H | p-$C_2H_5$ | p-$C_2H_5$ | $Cl^-$ |
| T-11 | H | m-$C_2H_5$ | m-$C_2H_5$ | $Cl^-$ |
| T-12 | H | p-$C_3H_7$ | p-$C_3H_7$ | $Cl^-$ |
| T-13 | H | p-$OC_2H_5$ | p-$OC_2H_5$ | $Cl^-$ |
| T-14 | H | p-$OCH_3$ | p-$OCH_3$ | $Cl^-$ |
| T-15 | H | p-$OCH_3$ | p-$OC_2H_5$ | $Cl^-$ |
| T-16 | H | p-$OC_5H_{11}$ | p-$OCH_3$ | $Cl^-$ |
| T-17 | H | p-$OC_8H_{17}$-n | p-$OC_8H_{17}$-n | $Cl^-$ |
| T-18 | H | p-$C_{12}H_{25}$-n | p-$C_{12}H_{25}$-n | $Cl^-$ |
| T-19 | H | p-$N(CH_3)_2$ | p-$N(CH_3)_2$ | Cl |
| T-20 | H | p-$NH_2$ | p-$NH_2$ | $Cl^-$ |
| T-21 | H | p-OH | p-OH | $Cl^-$ |
| T-22 | H | m-OH | m-OH | $Cl^-$ |
| T-23 | H | p-Cl | p-Cl | $Cl^-$ |
| T-24 | H | m-Cl | m-Cl | $Cl^-$ |
| T-25 | p-CN | p-$CH_3$ | p-$CH_3$ | $Cl^-$ |
| T-26 | p-SH | p-$OCH_3$ | p-$OCH_3$ | $Cl^-$ |
| T-27 | H | p-$OCH_3$ | p-$OCH_3$ | 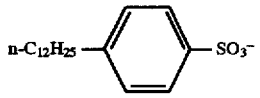 |

EXAMPLES

The example of the invention will be detailed below, but the invention is not limited thereto.

Example 1

RSD-3A (light sensitive material 1 containing no contrast increasing agent) produced by Konica Corporation and Sample (light sensitive material 2) containing Exemplified Compound T-6 were processed according to the following conditions:

<Prescription of developer starting solution (D-1)>

| | |
|---|---|
| Pentasodium diethylenetriamine pentaacetate | 1.3 g |
| Diethylene glycol | 50 g |
| Sodium sulfite | 50 g |
| Potassium carbonate | 65 g |
| Hydroquinone | 20 g |
| 5-Methyl-benzotriazole | 250 mg |
| 5-Nitroindazole | 120 mg |
| 1-Phenyl-5-mercaptotetrazole | 50 mg |
| 1-Phenyl-4-methyl-hydroxymethyl-3-pyrazolidone | 890 mg |
| Potassium bromide | 10 g |
| 2-Mercaptohypoxanthine | 150 mg |
| Potassium hydroxide | amount necessary to give pH 10.2 |

Add pure water to make 1 liter

<Prescription of developer replenisher solution (D-1 Rep 1)>

| | |
|---|---|
| Sodium sulfite | 50 g |
| Potassium carbonate | 80 g |
| Hydroquinone | amount shown in Table 1 |
| 5-Methyl-benzotriazole | 500 mg |
| 5-Nitroindazole | 200 mg |
| 1-Phenyl-5-mercaptotetrazole | 100 mg |
| 1-Phenyl-4-methyl-hydroxymethyl-3-pyrazolidone | 890 mg |
| Potassium bromide | 1.5 g |
| 2-Mercaptohypoxanthine | 300 mg |
| Potassium hydroxide | amount necessary to give pH 10.4 |

Add water to make 1 liter.

<Prescription of granular developer replenisher (D-1 Rep 2)>

| | |
|---|---|
| Composition A | |
| Hydroquinone | amount shown in Table 1 |
| 1-Phenyl-4-methyl-hydroxymethyl-3-pyrazolidone | 890 mg |
| Water (a binder for glanulation) | 0.4 g |
| Composition B | |
| Sodium sulfite | 50 g |
| Potassium bromide | 1.5 g |
| Potassium carbonate | 80 g |
| 5 Methyl-benzotriazole | 500 mg |
| 5-Nitroindazole | 200 mg |

-continued

| | |
|---|---|
| 1-Phenyl-5-mercaptotetrazole | 100 mg |
| 2-Mercaptohypoxanthine | 300 mg |
| Potassium hydroxide | amount necessary to give pH 10.4 when compositions A and B are dissolved in 1 liter water. |

The above compositions A and B were independently mixed sufficiently, and granulated according to an extrusion granulating method to about 2 mm. The resulting granules were dried at 40° C. and 20% RH for 24 hours to obtain granules A and B. Thereafter, Granules A and B were independently divided into ten parts, and were accommodated in a 20 μm polyethylene package so that A and B were piled.

D-1 Rep-1 was replenished in an amount of 100 ml per $m^2$ of light sensitive material processed from the replenishing tank through a bellows pump, and D-1 Rep-2 was incorporated into the replenishing tank in the amount contained in one package per $m^2$ of light sensitive material processed and water in the amount shown in Table 1. The replenishing tank connects the developing tank and has a water inlet. The developer was circulated from the developing tank and the replenishing tank.

The samples were processed using an automatic developing machine GR-27 (the developer tank volume is 41 liter), produced by Konica Corporation, which was modified, and fixer, CFL-871 (produced by Konica Corporation) according to the following processing conditions:

| | | |
|---|---|---|
| Developing | 28° C. | 30 seconds |
| Fixing | 28° C. | 20 seconds |
| Washing | 25° C. | 20 seconds |
| Drying | 45° C. | 20 seconds |

Each of sensitive material 1 having an exposed area of 50% and light sensitive material 2 having an exposed area of 30% was processed. Sensitivity (relative to sensitivity of a light sensitive material processed with a fresh developer defined to be 100), fog, dot quality (ranked 1 to 5) and maximum density of light sensitive material processed with the running solution of the invention were evaluated compared to those of light sensitive material processed with the fresh developer. Unexposed samples were further processed with the running developer and observed for stains at a 5 stage evaluation criterion (ranking 5 represents no stains, and ranking of not less than 3 can be put into practical use). Regarding the amount of developer waste, overflow was measured.

The results are shown in Tables 1 and 2.

TABLE 1

| Experiment No. | Light Sensitive Material | Processed Material | Replenisher | Hydroquinone Amount: Addition Amount (g) | Hydroquinone Amount: Concentration Ratio $D_R/D_S$ | Water Replenishing Amount ($ml/m^2$) |
|---|---|---|---|---|---|---|
| 1 | Light Sensitive Material 1 | Light Sensitive Material 1 | Starting Solution (D-1) | — | 0.62 | — |
| 2 | " | " | D-1 Rep 1 | 20 | 0.63 | — |
| 3 | " | " | " | 30 | 1.05 | — |
| 4 | " | " | " | 32 | 1.14 | — |
| 5 | " | " | " | 35 | 1.24 | — |
| 6 | " | " | " | 40 | 1.40 | — |
| 7 | " | " | D-1 Rep 2 | 30 | 1.06 | 100 |
| 8 | " | " | " | 32 | 1.15 | 100 |
| 9 | " | " | " | 35 | 1.25 | 100 |
| 10 | " | " | " | 40 | 1.40 | 100 |
| 11 | " | " | " | 40 | 1.32 | 80 |
| 12 | " | " | " | 40 | 1.24 | 50 |
| 13 | Light Sensitive Material 2 | Light Sensitive Material 2 | Starting Solution (D-1) | — | 0.75 | — |
| 14 | " | " | D-1 Rep 1 | 20 | 0.77 | — |
| 15 | " | " | " | 30 | 1.15 | — |
| 16 | " | " | " | 32 | 1.17 | — |
| 17 | " | " | " | 35 | 1.32 | — |
| 18 | " | " | " | 40 | 1.51 | — |
| 19 | " | " | D-1 Rep 2 | 30 | 1.18 | 100 |
| 20 | " | " | " | 35 | 1.34 | 100 |
| 21 | " | " | " | 40 | 1.51 | 100 |
| 22 | " | " | " | 40 | 1.42 | 70 |
| 23 | " | " | " | 40 | 1.35 | 40 |
| 24 | " | " | " | 40 | 1.20 | 20 |

TABLE 2

| Experiment No. | Fresh Developer Sensitivity | Fog | Dot Quality (Rank) | Maximum Density | Running Developer in Stationary State Sensitivity | Fog | Dot Quality (Rank) | Maximum Density | Silver Sludge (Rank) | Developer Waste (l) | Remarks |
|---|---|---|---|---|---|---|---|---|---|---|---|
| 1 | 100 | 0.02 | 3.5 | 5.2 | 45 | 0.08 | 1.5 | 3.7 | 2.0 | 40 | Comparative |
| 2 | 100 | 0.02 | 3.5 | 5.2 | 49 | 0.03 | 2.0 | 4.0 | 3.5 | 40 | Comparative |
| 3 | 100 | 0.02 | 3.5 | 5.2 | 70 | 0.03 | 2.5 | 4.5 | 3.5 | 40 | Comparative |
| 4 | 100 | 0.02 | 3.5 | 5.2 | 90 | 0.03 | 3.5 | 4.9 | 3.5 | 40 | Invention |
| 5 | 100 | 0.02 | 3.5 | 5.2 | 92 | 0.03 | 3.5 | 5.0 | 3.5 | 40 | Invention |
| 6 | 100 | 0.02 | 3.5 | 5.2 | 98 | 0.02 | 3.5 | 5.1 | 3.5 | 40 | Invention |
| 7 | 100 | 0.02 | 3.5 | 5.2 | 72 | 0.03 | 2.5 | 4.3 | 3.5 | 40 | Comparative |
| 8 | 100 | 0.02 | 3.5 | 5.2 | 92 | 0.02 | 3.5 | 5.0 | 3.5 | 40 | Invention |
| 9 | 100 | 0.02 | 3.5 | 5.2 | 94 | 0.02 | 3.5 | 5.0 | 3.5 | 40 | Invention |
| 10 | 100 | 0.02 | 3.5 | 5.2 | 99 | 0.02 | 3.5 | 5.1 | 3.5 | 40 | Invention |
| 11 | 100 | 0.02 | 3.5 | 5.2 | 98 | 0.02 | 3.5 | 5.1 | 3.5 | 32 | Invention |
| 12 | 100 | 0.02 | 3.5 | 5.2 | 96 | 0.02 | 3.5 | 5.0 | 3.5 | 20 | Invention |
| 13 | 100 | 0.02 | 4.75 | 5.6 | 61 | 0.10 | 1.5 | 3.2 | 2.5 | 40 | Comparative |
| 14 | 100 | 0.02 | 4.75 | 5.6 | 67 | 0.05 | 2.0 | 4.0 | 3.5 | 40 | Comparative |
| 15 | 100 | 0.02 | 4.75 | 5.6 | 90 | 0.02 | 3.5 | 5.25 | 3.5 | 40 | Invention |
| 16 | 100 | 0.02 | 4.75 | 5.6 | 93 | 0.02 | 3.5 | 5.3 | 3.5 | 40 | Invention |
| 17 | 100 | 0.02 | 4.75 | 5.6 | 95 | 0.02 | 4.5 | 5.3 | 3.5 | 40 | Invention |
| 18 | 100 | 0.02 | 4.75 | 5.6 | 98 | 0.02 | 4.5 | 5.4 | 3.5 | 40 | Invention |
| 19 | 100 | 0.02 | 4.75 | 5.6 | 93 | 0.02 | 3.5 | 5.3 | 3.25 | 40 | Invention |
| 20 | 100 | 0.02 | 4.75 | 5.6 | 97 | 0.02 | 4.5 | 5.5 | 3.5 | 40 | Invention |
| 21 | 100 | 0.02 | 4.75 | 5.6 | 101 | 0.02 | 4.75 | 5.6 | 3.5 | 40 | Invention |
| 22 | 100 | 0.02 | 4.75 | 5.6 | 100 | 0.02 | 4.75 | 5.6 | 3.5 | 28 | Invention |
| 23 | 100 | 0.02 | 4.75 | 5.6 | 97 | 0.02 | 4.75 | 5.4 | 3.5 | 16 | Invention |
| 24 | 100 | 0.02 | 4.75 | 5.6 | 93 | 0.02 | 4.5 | 5.2 | 3.5 | 8 | Invention |

As is apparent from Table 2, the invention can maintain stable photographic properties such as sensitivity, fog, dot quality and maximum density even when a light sensitive material is processed through a process in which developer waste is reduced.

Example 2

Sample (light sensitive material 3) containing a hydrazine compound described in Example 2 of Japanese Patent O.P.I. Publication No. 5-241264/1993 were processed and evaluated in the same manner as in Example 1, except that the following developer compositions and processing conditions were employed and the exposed area was 50%.

The hydrazine compound used herein had the following chemical structure:

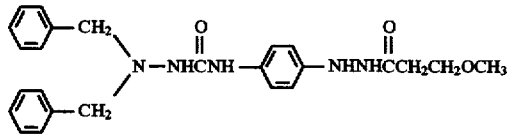

<Prescription of developer starting solution (D-2)>

| | |
|---|---|
| Pentasodium diethylenetriamine pentaacetate | 1.4 g |
| Diethylene glycol | 40 g |
| Sodium sulfite | 52 g |
| Potassium carbonate | 55 g |
| Hydroquinone | 20 g |

-continued

| | |
|---|---|
| 5-Methyl-benzotriazole | 0.20 g |
| 1-phenyl-5-mercaptotetrazole | 0.30 g |
| 1-Phenyl-4-methyl-hydroxymethyl-3-pyrazolidone | 1.0 g |
| Potassium bromide | 7 g |
| 2-Mercaptohypoxanthine | 120 mg |
| Boric acid | 10 g |
| Potassium hydroxide | amount necessary to give pH 10.4 |

Add pure water to make 1 liter

<Prescription of developer replenisher solution (D-2 Rep 1)>

| | |
|---|---|
| Sodium sulfite | 52 g |
| Potassium carbonate | 70 g |
| Hydroquinone | amount shown in Table 3 |
| 5-Methyl-benzotriazole | 0.35 g |
| 1-Phenyl-5-mercaptotetrazole | 70 mg |
| 1-Phenyl-4-methyl-hydroxylmethyl-3-pyrazolidone | 1.5 g |
| 2-Mercaptohypoxanthine | 200 mg |
| Boric acid | 5 g |
| Potassium hydroxide | amount necessary to give pH 10.4 |

Add water to make 1 liter.

<Prescription of granular developer replenisher (D-2 Rep 2)>

| Composition A | |
|---|---|
| Hydroquinone | amount shown in Table 3 |
| 1-Phenyl-4-methyl-hydroxymethyl-3-pyrazolidone | 1.5 g |
| Boric acid | 5 g |
| Water (a binder for granulation) | 0.4 g |

-continued

| Composition B | |
|---|---|
| Sodium sulfite | 52 g |
| Potassium carbonate | 70 g |
| 5-Methyl-benzotriazole | 0.35 g |
| 1-phenyl-5-mercaptotetrazole | 70 mg |
| 2-Mercaptohypoxanthine | 200 mg |
| Potassium hydroxide | amount necessary to give pH 10.4 when Compositions A and B are dissolved in 1 liter water. |

The above compositions A and B were granulated in the same manner as in Example 1 to obtain granular replenishers.

<Prescription and preparation of tablet developer replenisher (D-2 Rep 3)>

| Preparation of Granules A | |
|---|---|
| Pentasodium diethylenetriamine pentaacetate | 1.45 g |
| Sodium sulfite | 52 g |
| 8-mercaptoadenine | 0.1 g |
| 5-Methyl-benzotriazole | 0.35 g |
| 1-Phenyl-5-mercaptotetrazole | 70 mg |
| Dimeson S | 1.5 g |
| Potassium carbonate | 70 g |
| Hydroquinone | amount shown in Table 3 |
| Pineflow by Matsutani Kagaku Co., Ltd. | 4 g |

The above compounds were mixed for 30 minutes in a bandam mill available on the market, and granulated at room temperature for 10 minutes in a granulator available on the market. Thereafter, the resulting granules were dried at 40° C. for 2 hours in a fluid-bed drier available on the market to obtain Granules A.

| Preparation of Granules B | |
|---|---|
| Potassium carbonate | 70 g |
| D-Mannitol | 5 g |
| Lithium hydroxide | 3 g |

The above compounds were mixed for 30 minutes in a bandam mill available on the market, and granulated at room temperature for 10 minutes in a granulator available on the market. Thereafter, the resulting granules were dried at 40° C. for 2 hours in a fluid-bed drier available on the market to obtain Granules B.

Granules A and B were completely mixed for 30 minutes and the resulting mixture was tableted at a compression of 1.5 ton/m$^2$ by means of a tableting machine, Machina UD.DFE30.40 (produced by Machina Co., Ltd.). Thus, thirty tablets were obtained with a diameter of 30 mm and a thickness of 10 mm. Three tablets were packed in 20 μm polyester packages. D-2 Rep-3 was incorporated into the replenishing tank in the amount of one package per m$^2$ of light sensitive material processed and water in the amount shown in Table 3.

Processing Conditions

| | | |
|---|---|---|
| Developing | 35° C. | 36 seconds |
| Fixing | 33° C. | 20 seconds |
| Washing | 25° C. | 20 seconds |
| Drying | 43° C. | 20 seconds |

The results are shown in Tables 3 and 4.

TABLE 3

| Experiment No. | Light Sensitive Material | Processed Material | Replenisher | Hydroquinone Amount: Addition Amount (g) | Hydroquinone Amount: Concentration Ratio $D_R/D_S$ | Water Replenishing Amount (ml/m$^2$) |
|---|---|---|---|---|---|---|
| 25 | Light Sensitive Material 3 | Light Sensitive Material 3 | Starting Solution (D-2) | — | 0.52 | — |
| 26 | " | " | D-2 Rep 1 | 20 | 0.54 | — |
| 27 | " | " | " | 30 | 0.98 | — |
| 28 | " | " | " | 32 | 1.14 | — |
| 29 | " | " | " | 35 | 1.26 | — |
| 30 | " | " | " | 40 | 1.35 | — |
| 31 | " | " | D-2 Rep 2 | 30 | 1.00 | 100 |
| 32 | " | " | " | 32 | 1.14 | 100 |
| 33 | " | " | " | 35 | 1.27 | 100 |
| 34 | " | " | " | 40 | 1.40 | 100 |
| 35 | " | " | " | 40 | 1.35 | 80 |
| 36 | " | " | " | 40 | 1.27 | 50 |
| 37 | " | " | " | 40 | 1.21 | 30 |
| 38 | " | " | " | 30 | 1.00 | 100 |
| 39 | " | " | " | 32 | 1.16 | 100 |
| 40 | " | " | " | 35 | 1.27 | 100 |

TABLE 4

| Experiment No. | Fresh Solution Sensitivity | Fresh Solution Fog | Fresh Solution Dot Quality (Rank) | Fresh Solution Maximum Density | Solution after 400 m² light sensitive material are processed Sensitivity | Solution after 400 m² light sensitive material are processed Fog | Solution after 400 m² light sensitive material are processed Dot Quality (Rank) | Solution after 400 m² light sensitive material are processed Maximum Density | Silver Sludge (Rank) | Developer Waste (l) | Remarks |
|---|---|---|---|---|---|---|---|---|---|---|---|
| 25 | 100 | 0.02 | 5 | 5.1 | 52 | 0.09 | 1.5 | 3.2 | 2.5 | 40 | Comparative |
| 26 | 100 | 0.02 | 5 | 5.1 | 56 | 0.08 | 1.5 | 3.6 | 3.5 | 40 | Comparative |
| 27 | 100 | 0.02 | 5 | 5.1 | 70 | 0.05 | 2.0 | 4.0 | 3.5 | 40 | Comparative |
| 28 | 100 | 0.02 | 5 | 5.1 | 93 | 0.02 | 4.5 | 5.0 | 3.5 | 40 | Invention |
| 29 | 100 | 0.02 | 5 | 5.1 | 95 | 0.02 | 4.5 | 5.0 | 3.5 | 40 | Invention |
| 30 | 100 | 0.02 | 5 | 5.1 | 97 | 0.02 | 4.75 | 5.05 | 3.5 | 40 | Invention |
| 31 | 100 | 0.02 | 5 | 5.1 | 79 | 0.04 | 2.5 | 4.1 | 3 | 40 | Comparative |
| 32 | 100 | 0.02 | 5 | 5.1 | 93 | 0.02 | 4.5 | 5.0 | 3.5 | 40 | Invention |
| 33 | 100 | 0.02 | 5 | 5.1 | 96 | 0.02 | 4.5 | 5.0 | 3.5 | 40 | Invention |
| 34 | 100 | 0.02 | 5 | 5.1 | 99 | 0.02 | 4.75 | 5.05 | 3.5 | 40 | Invention |
| 35 | 100 | 0.02 | 5 | 5.1 | 98 | 0.02 | 4.75 | 5.05 | 3.5 | 32 | Invention |
| 36 | 100 | 0.02 | 5 | 5.1 | 97 | 0.02 | 4.75 | 5.05 | 3.5 | 20 | Invention |
| 37 | 100 | 0.02 | 5 | 5.1 | 95 | 0.02 | 4.75 | 4.95 | 3.5 | 12 | Invention |
| 38 | 100 | 0.02 | 5 | 5.1 | 82 | 0.04 | 2.5 | 4.2 | 3 | 40 | Comparative |
| 39 | 100 | 0.02 | 5 | 5.1 | 91 | 0.02 | 4.25 | 4.9 | 3 | 40 | Invention |
| 40 | 100 | 0.02 | 5 | 5.1 | 96 | 0.02 | 4.5 | 5.0 | 3.5 | 40 | Invention |

As is apparent from Table 4, the invention can maintain stable photographic properties such as sensitivity, fog, dot quality and maximum density even when a light sensitive material is processed through a process in which developer waste is reduced.

Example 3

Evaluation was conducted in the same manner as in Example 1, except that the following developer and replenishers were employed.

<Prescription of developer starting solution (D-3)>

| | |
|---|---|
| Pentasodium diethylenetriamine pentaacetate | 1.3 g |
| Diethylene glycol | 50 g |
| Sodium sulfite | 50 g |
| Potassium carbonate | 65 g |
| A-17 | 35 g |
| 5-Methyl-benzotriazole | 250 mg |
| 5-Nitroindazole | 120 mg |
| 1-Phenyl-5-mercaptotetrazole | 50 mg |
| 1-Phenyl-4-methyl-hydroxymethyl-3-pyrazolidone | 890 mg |
| Potassium bromide | 10 g |
| 2-Mercaptohypoxanthine | 150 mg |
| Potassium hydroxide | amount necessary to give pH 10.2 |

Add pure water to make 1 liter.

<Prescription of developer replenisher solution (D-3 Rep 1)>

| | |
|---|---|
| Sodium sulfite | 50 g |
| Potassium carbonate | 80 g |

-continued

| | |
|---|---|
| A-17 | amount shown in Table 5 |
| 5-Methyl-benzotriazole | 500 mg |
| 5-Nitroindazole | 200 mg |
| 1-Phenyl-5-mercaptotetrazole | 100 mg |
| 1-Phenyl-4-methyl-hydroxymethyl-3-pyrazolidone | 890 mg |
| Potassium bromide | 1.5 g |
| 2-Mercaptohypoxanthine | 350 mg |
| Potassium hydroxide | amount necessary to give pH 10.4 |

Add water to make 1 liter.

<Prescription of granular developer replenisher (D-3 Rep 2)>

| | |
|---|---|
| Composition A | |
| A-17 | amount shown in Table 5 |
| 1-Phenyl-4-methyl-hydroxymethyl-3-pyrazolidone | 890 mg |
| Water (a binder for granulation) | 0.4 g |
| Composition B | |
| Sodium sulfite | 50 g |
| Potassium bromide | 1.5 g |
| Potassium carbonate | 80 g |
| 5-Methyl-benzotriazole | 500 mg |
| 5-Nitroindazole | 200 mg |
| 1-Phenyl-5-mercaptotetrazole | 100 mg |
| 2-Mercaptohypoxanthine | 300 mg |
| Potassium hydroxide | amount necessary to give pH 10.4 when Compositions A and B are dissolved in 1 liter water. |

The results are shown in Tables 5 and 6.

TABLE 5

| Experiment No. | Light Sensitive Material | Processed Material | Replenisher | A-17 Amount: Addition Amount (g) | A-17 Amount: Concentration Ratio $D_R/D_S$ | Water Replenishing Amount ($ml/m^2$) |
|---|---|---|---|---|---|---|
| 41 | Light Sensitive Material 1 | Light Sensitive Material 1 | D-3 Rep 1 | 35 | 0.63 | — |
| 42 | " | " | " | 40 | 0.90 | — |
| 43 | " | " | " | 42 | 1.15 | — |
| 44 | " | " | " | 45 | 1.21 | — |
| 45 | " | " | " | 60 | 1.35 | — |
| 46 | " | " | D-3 Rep 2 | 35 | 0.64 | 100 |
| 47 | " | " | " | 40 | 0.92 | 100 |
| 48 | " | " | " | 42 | 1.14 | 100 |
| 49 | " | " | " | 50 | 1.28 | 100 |
| 50 | " | " | " | 60 | 1.38 | 100 |
| 51 | " | " | " | 60 | 1.27 | 80 |
| 52 | " | " | " | 60 | 1.24 | 60 |
| 53 | Light Sensitive Material 2 | Light Sensitive Material 2 | D-3 Rep 1 | 35 | 0.81 | — |
| 54 | " | " | " | 45 | 1.14 | — |
| 55 | " | " | " | 55 | 1.27 | — |
| 56 | " | " | " | 65 | 1.51 | — |
| 57 | " | " | D-3 Rep 2 | 35 | 0.85 | 100 |
| 58 | " | " | " | 45 | 1.18 | 100 |
| 59 | " | " | " | 55 | 1.31 | 100 |
| 60 | " | " | " | 65 | 1.45 | 100 |
| 61 | " | " | " | 65 | 1.40 | 80 |
| 62 | " | " | " | 65 | 1.30 | 60 |
| 63 | " | " | " | 65 | 1.22 | 40 |

TABLE 6

| Experiment No. | Fresh Developer: Sensitivity | Fresh Developer: Fog | Fresh Developer: Dot Quality (Rank) | Fresh Developer: Maximum Density | Running Developer in Stationary State: Sensitivity | Running Developer in Stationary State: Fog | Running Developer in Stationary State: Dot Quality (Rank) | Running Developer in Stationary State: Maximum Density | Silver Sludge (Rank) | Developer Waste (l) | Remarks |
|---|---|---|---|---|---|---|---|---|---|---|---|
| 41 | 100 | 0.02 | 3.5 | 5.3 | 48 | 0.11 | 1.5 | 3.6 | 3.0 | 40 | Comparative |
| 42 | 100 | 0.02 | 3.5 | 5.3 | 54 | 0.07 | 2.0 | 4.2 | 3.5 | 40 | Comparative |
| 43 | 100 | 0.02 | 3.5 | 5.3 | 95 | 0.02 | 3.25 | 5.1 | 3.5 | 40 | Invention |
| 44 | 100 | 0.02 | 3.5 | 5.3 | 96 | 0.02 | 3.25 | 5.1 | 3.5 | 40 | Invention |
| 45 | 100 | 0.02 | 3.5 | 5.3 | 98 | 0.02 | 3.5 | 5.2 | 3.5 | 40 | Invention |
| 46 | 100 | 0.02 | 3.5 | 5.3 | 49 | 0.05 | 1.5 | 3.7 | 3.0 | 40 | Comparative |
| 47 | 100 | 0.02 | 3.5 | 5.3 | 60 | 0.04 | 2.0 | 4.4 | 3.0 | 40 | Comparative |
| 48 | 100 | 0.02 | 3.5 | 5.3 | 95 | 0.02 | 3.25 | 5.0 | 3.5 | 40 | Invention |
| 49 | 100 | 0.02 | 3.5 | 5.3 | 96 | 0.02 | 3.25 | 5.0 | 3.5 | 40 | Invention |
| 50 | 100 | 0.02 | 3.5 | 5.3 | 98 | 0.02 | 3.5 | 5.3 | 3.5 | 40 | Invention |
| 51 | 100 | 0.02 | 3.5 | 5.3 | 96 | 0.02 | 3.5 | 5.2 | 3.5 | 32 | Invention |
| 52 | 100 | 0.02 | 3.5 | 5.3 | 95 | 0.02 | 3.25 | 5.1 | 3.5 | 24 | Invention |
| 53 | 100 | 0.02 | 4.5 | 5.7 | 65 | 0.10 | 2.5 | 3.7 | 3.0 | 40 | Comparative |
| 54 | 100 | 0.02 | 4.5 | 5.7 | 93 | 0.02 | 4.0 | 5.5 | 3.0 | 40 | Invention |
| 55 | 100 | 0.02 | 4.5 | 5.7 | 96 | 0.02 | 4.25 | 5.6 | 3.5 | 40 | Invention |
| 56 | 100 | 0.02 | 4.5 | 5.7 | 102 | 0.02 | 4.5 | 5.8 | 3.5 | 40 | Invention |
| 57 | 100 | 0.02 | 4.5 | 5.7 | 68 | 0.05 | 2.75 | 3.8 | 3.0 | 40 | Comparative |
| 58 | 100 | 0.02 | 4.5 | 5.7 | 94 | 0.02 | 4.5 | 5.6 | 3.0 | 40 | Invention |
| 59 | 100 | 0.02 | 4.5 | 5.7 | 99 | 0.02 | 4.5 | 5.7 | 3.5 | 40 | Invention |
| 60 | 100 | 0.02 | 4.5 | 5.7 | 101 | 0.02 | 4.5 | 5.8 | 3.5 | 40 | Invention |
| 61 | 100 | 0.02 | 4.5 | 5.7 | 97 | 0.02 | 4.5 | 5.7 | 3.5 | 32 | Invention |
| 62 | 100 | 0.02 | 4.5 | 5.7 | 96 | 0.02 | 4.25 | 5.5 | 3.5 | 24 | Invention |
| 63 | 100 | 0.02 | 4.5 | 5.7 | 93 | 0.02 | 4.0 | 5.4 | 3.0 | 16 | Invention |

As is apparent from Table 6, the invention can maintain stable photographic properties such as sensitivity, fog, dot quality and maximum density even when a light sensitive material is processed through a process in which developer waste is reduced.

Example 4

Evaluation was conducted in the same manner as in Example 2, except that the following developer and replenishers were employed.

<Prescription of developer starting solution (D-4)>

| | |
|---|---|
| Pentasodium diethylenetriamine pentaacetate | 1.4 g |
| Diethylene glycol | 40 g |
| Sodium sulfite | 52 g |
| Potassium carbonate | 55 g |
| A-17 | 30 g |
| 5-Methyl-benzotriazole | 0.20 g |
| 1-Phenyl-5-mercaptotetrazole | 0.30 g |
| 1-Phenyl-4-methyl-hydroxymethyl-3-pyrazolidone | 1.0 g |
| Potassium bromide | 7 g |
| 2 Mercaptohypoxanthine | 120 mg |
| Boric acid | 10 g |
| Potassium hydroxide | amount necessary to give pH 10.4 |

Add pure water to make 1 liter.

<Prescription of developer replenisher solution (D-4 Rep 1)>

| | |
|---|---|
| Sodium sulfite | 52 g |
| Potassium carbonate | 70 g |
| A-17 | amount shown in Table 7 |
| 5-Methyl-benzotriazole | 0.35 g |
| 1-Phenyl-5-mercaptotetrazole | 70 mg |
| 1 Phenyl-4-methyl hydroxymethyl-3-pyrazolidone | 1.5 g |
| 2 Mercaptohypoxanthine | 200 mg |
| Boric acid | 5 g |
| Potassium hydroxide | amount necessary to give pH 10.4 |

Add water to make 1 liter.

<Prescription of granular developer replenisher (D-4 Rep 2)>

| Composition A | |
|---|---|
| A-17 | amount shown in Table 7 |
| 1-Phenyl-4-methyl-hydroxymethyl-3-pyrazolidone | 1.5 g |
| Boric acid | 5 g |
| Water (a binder for granulation) | 0.4 g |
| **Composition B** | |
| Sodium sulfite | 52 g |
| Potassium carbonate | 70 g |
| 5-Methyl-benzotriazole | 0.35 g |
| 1-Phenyl-5-mercaptotetrazole | 70 mg |
| 2 Mercaptohypoxanthine | 200 mg |
| Potassium hydroxide | amount necessary to give pH 10.4 when Compositions A and B are dissolved in 1 liter water. |

<Prescription and preparation of tablet developer replenisher (D-4 Rep 3)>

| Preparation of Granules A | |
|---|---|
| Pentasodium diethylenetriamine pentaacetate | 1.45 g |
| Sodium sulfite | 52 g |
| 8-mercaptoadenine | 0.1 g |
| 5-Methyl-benzotriazole | 0.35 g |
| 1-phenyl-5-mercaptotetrazole | 70 mg |
| Dimeson S | 1.5 g |
| Potassium carbonate | 70 g |
| A-17 | amount shown in Table 7 |
| Pineflow (produced by Matsutani Kagaku Co., Ltd.) | 4 g |

The above compounds were mixed for 30 minutes in a bandam mill available on the market, and granulated at room temperature for 10 minutes in a granulator available on the market. Thereafter, the resulting granules were dried at 40° C. for 2 hours in a fluid-bed drier available on the market to obtain Granules A.

| Preparation of Granules B | |
|---|---|
| Potassium carbonate | 70 g |
| D-Mannitol | 5 g |
| Lithium hydroxide | 3 g |

The above compounds were mixed for 30 minutes in a bandam mill available on the market, and granulated at room temperature for 10 minutes in a granulator available on the market. Thereafter, the resulting granules were dried at 40° C. for 2 hours in a fluid-bed drier available on the market to obtain Granules B.

Granules A and B were completely mixed for 30 minutes, and the resulting mixture was tableted at a compression of 1.5 ton/m$^2$ by means of a tableting machine, Machina UD.DFE30.40 (produced by Machina Co., Ltd.). Thus, thirty tablets were obtained with a diameter of 30 mm and a thickness of 10 mm. Three tablets were packed in 20 μm thick polyester packages.

The results are shown in Tables 7 and 8.

TABLE 7

| Experiment No. | Light Sensitive Material | Processed Material | Replenisher | A-17 Amount: Addition Amount (g) | A-17 Amount: Concentration Ratio $D_R/D_S$ | Water Replenishing Amount (ml/m$^2$) |
|---|---|---|---|---|---|---|
| 64 | Light Sensitive Material 3 | Light Sensitive Material 3 | D-4 Rep 1 | 35 | 0.80 | — |
| 65 | " | " | " | 45 | 1.11 | — |
| 66 | " | " | " | 55 | 1.25 | — |
| 67 | " | " | " | 65 | 1.49 | — |
| 68 | " | " | D-4 Rep 2 | 35 | 0.82 | 100 |
| 69 | " | " | " | 45 | 1.15 | 100 |
| 70 | " | " | " | 55 | 1.29 | 100 |
| 71 | " | " | " | 65 | 1.52 | 100 |
| 72 | " | " | " | 65 | 1.46 | 80 |
| 73 | " | " | " | 65 | 1.40 | 60 |

TABLE 7-continued

| Experiment No. | Light Sensitive Material | Processed Material | Replenisher | A-17 Amount: Addition Amount (g) | A-17 Amount: Concentration Ratio $D_R/D_S$ | Water Replenishing Amount ($ml/m^2$) |
|---|---|---|---|---|---|---|
| 74 | " | " | " | 65 | 1.22 | 40 |
| 75 | " | " | D-4 Rep 3 | 37 | 1.01 | 100 |
| 76 | " | " | " | 45 | 1.16 | 100 |
| 77 | " | " | " | 55 | 1.30 | 100 |

TABLE 8

| Experiment No. | Fresh Developer: Sensitivity | Fresh Developer: Fog | Fresh Developer: Dot Quality (Rank) | Fresh Developer: Maximum Density | Running Developer in Stationary State: Sensitivity | Running Developer in Stationary State: Fog | Running Developer in Stationary State: Dot Quality (Rank) | Running Developer in Stationary State: Maximum Density | Silver Sludge (Rank) | Developer Waste (l) | Remarks |
|---|---|---|---|---|---|---|---|---|---|---|---|
| 64 | 100 | 0.02 | 5 | 5.4 | 65 | 0.08 | 2.0 | 3.8 | 2.5 | 40 | Comparative |
| 65 | 100 | 0.02 | 5 | 5.4 | 94 | 0.02 | 4.25 | 5.1 | 3.5 | 40 | Invention |
| 66 | 100 | 0.02 | 5 | 5.4 | 95 | 0.02 | 4.75 | 5.3 | 3.5 | 40 | Invention |
| 67 | 100 | 0.02 | 5 | 5.4 | 99 | 0.02 | 5 | 5.5 | 3.5 | 40 | Invention |
| 68 | 100 | 0.02 | 5 | 5.4 | 64 | 0.08 | 2.0 | 4 | 2.5 | 40 | Comparative |
| 69 | 100 | 0.02 | 5 | 5.4 | 93 | 0.02 | 4.5 | 5.2 | 3.0 | 40 | Invention |
| 70 | 100 | 0.02 | 5 | 5.4 | 96 | 0.02 | 4.75 | 5.3 | 3.5 | 40 | Invention |
| 71 | 100 | 0.02 | 5 | 5.4 | 101 | 0.02 | 4.75 | 5.4 | 3.5 | 40 | Invention |
| 72 | 100 | 0.02 | 5 | 5.4 | 100 | 0.02 | 5 | 5.5 | 3.5 | 32 | Invention |
| 73 | 100 | 0.02 | 5 | 5.4 | 99 | 0.02 | 5 | 5.4 | 3.5 | 24 | Invention |
| 74 | 100 | 0.02 | 5 | 5.4 | 97 | 0.02 | 4.75 | 5.3 | 3.0 | 16 | Invention |
| 75 | 100 | 0.02 | 5 | 5.4 | 70 | 0.06 | 2.5 | 4.2 | 3.0 | 40 | Comparative |
| 76 | 100 | 0.02 | 5 | 5.4 | 94 | 0.02 | 4.50 | 5.3 | 3.5 | 40 | Invention |
| 77 | 100 | 0.02 | 5 | 5.4 | 101 | 0.02 | 4.75 | 5.4 | 3.5 | 40 | Invention |

As is apparent from Table 8, the invention can maintain stable photographic properties such as sensitivity, fog, dot quality and maximum density even when a light sensitive material is processed through a process in which developer waste is reduced.

What is claimed is:

1. A method of processing a black and white silver halide photographic light sensitive material, using an automatic developing machine, the method comprising the steps of:

exposing the material; and developing the exposed material with developer, the developer being replenished with developer replenisher and the developer containing 0.05 to 0.5 mol/liter of a developing agent represented by Formula (A-a):

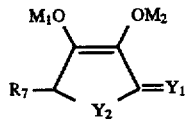

Formula (A-a)

wherein $R_7$ represents a hydrogen atom, an alkyl group, an aryl group, an amino group, an alkoxy group, a sulfo group, a carboxy group, an amido group or a sulfonamido group; $M_1$ and $M_2$ independently represent a hydrogen atom or an alkali metal atom; $Y_1$ represents O or S; and $Y_2$ represents O, S or $NR_8$ in which $R_8$ represents a hydrogen atom, an alkyl group or an aryl group, wherein the method satisfies the following inequality:

$$1.1 \leq D_R/D_S \leq 2.5$$

in which $D_S$ represents the developing agent concentration of a fresh developer and $D_R$ represents the developing agent concentration of a running developer in stationary state.

2. The method of claim 1, wherein the method satisfies the following inequality:

$$1.2 \leq D_R/D_S \leq 2.5.$$

3. The method of claim 1, wherein the concentration $D_{AS}$ of the developing agent represented by Formula (A-a) of the fresh developer satisfies the following inequality:

$$0.15 \text{ mol/l} \leq D_{AS} \leq 1.50 \text{ mol/l}.$$

4. The method of claim 1, wherein the developer further comprises an auxiliary developing agent showing superadditivity.

5. The method of claim 4, wherein the auxiliary developing agent is a 3-pyrazolidone derivative or an aminophenol derivative.

6. The method of claim 1, wherein the developer replenisher has a composition different from that of the fresh developer.

7. The method of claim 6, wherein the developer replenisher is in the form of a solid.

8. The method of claim 1, wherein the silver halide photographic light-sensitive material comprises a hydrazine compound represented by the following Formula (H):

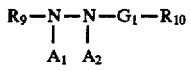

Formula (H)

wherein $R_9$ represents an aliphatic group or an aromatic group; $R_{10}$ represents a hydrogen atom, an alkyl group, an aryl group, an alkoxy group, an aryloxy group, an amino group, a hydrazino group, a carbamoyl group or an oxycarbonyl group; $G_1$ represents a carbonyl group, a sulfonyl group, a sulfoxy group,

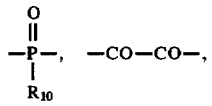

a thiocarbonyl group or an iminomethylene group; and $A_1$ and $A_2$ both are hydrogen atoms or when one of $A_1$ and $A_2$ represents a hydrogen atom, the other represents an alkylsulfonyl group, an arylsulfonyl group or an acyl group.

9. The method of claim 1, wherein the silver halide photographic light-sensitive material comprises a tetrazolium compound represented by the following Formula (T):

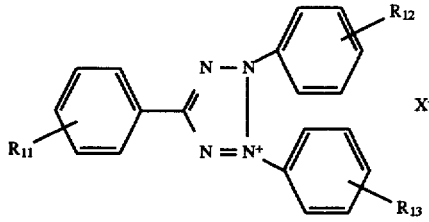

Formula (T)

wherein $R_{11}$, $R_{12}$, and $R_{13}$ independently represent a hydrogen atom, an alkyl group, an amino group, an acylamino group, a hydroxyl group, an alkoxy group, an acyloxy group, a halogen atom, a carbamoyl group, an acylthio group, an alkoxycarbonyl group, a carboxyl group, an acyl group, a cyano group, a nitro group, a mercapto group, a sulfoxy group or an aminosulfoxy group; and $X^-$ represents an anion.

10. The method of claim 1 wherein $Y_1$ is O;

$Y_2$ is O;

$M_1$ is H;

$M_2$ is H; and $R_7$ is H, $CH_3$, $CH_2OH$, $CH_3CH(OH)$, $HOCH_2CH(OH)$, or $HOOCCH_2CH(OH)$.

11. The method of claim 10 wherein $R_7$ is $HOCH_2CH(OH)$.

* * * * *